United States Patent [19]

Latter

[11] 4,246,477

[45] Jan. 20, 1981

[54] ARTIFICIAL AND SOLAR LIGHTING SYSTEM

[75] Inventor: Albert L. Latter, Marina del Rey, Calif.

[73] Assignee: R & D Associates, Marina del Rey, Calif.

[21] Appl. No.: 943,048

[22] Filed: Sep. 18, 1978

[51] Int. Cl.[3] ..... F21V 33/00

[52] U.S. Cl. ..... 250/214 AL; 350/262; 362/276; 362/20

[58] Field of Search ..... 250/214 AL, 216; 350/258, 259, 262, 264, 265; 362/1, 20, 276

[56] References Cited

U.S. PATENT DOCUMENTS

| | | | |
|---|---|---|---|
| 507,999 | 11/1893 | Davis | 353/3 |
| 1,254,520 | 1/1918 | Macduff | 350/264 |
| 3,488,505 | 1/1970 | Jentoft et al. | 250/205 |
| 3,511,559 | 5/1970 | Foster | 350/258 |
| 3,902,056 | 8/1975 | Aizenberg et al. | 350/264 |
| 4,023,034 | 5/1977 | Schacht | 362/276 X |
| 4,122,334 | 10/1978 | Owens | 250/214 AL X |

FOREIGN PATENT DOCUMENTS

| | | | |
|---|---|---|---|
| 1501297 | 2/1978 | United Kingdom | 350/258 |

OTHER PUBLICATIONS

M. A. Duguay et al., "Lighting with Sunlight Using Sun Tracking Concentrators"; Applied Optics, vol. 16, #5, May 1977; pp. 1444–1446.

*Primary Examiner*—David C. Nelms
*Assistant Examiner*—Edward P. Westin
*Attorney, Agent, or Firm*—Poms, Smith, Lande & Rose

[57] ABSTRACT

A sunlight collector, containing a Fresnel lens, is mounted on the roof of a building and tracks the sun during daylight hours. A concentrated beam of sunlight is directed through a light transmission channel to locations within the building where the light is distributed. The transmission channel utilizes a focusing lens for further concentrating the solar beam, refocusing lenses for correcting divergences in the beam, reflectors for redirecting the beam, and beam splitters for distributing the beam into light fixtures located throughout the interior of the building. The light fixtures contain filters for controlling the intensity and spectral content of the incoming beam, and optical elements for dispersing the beam. Additionally, the fixture contains rigidly mounted fluorescent tubes, providing artificial light, which are automatically energized when the solar light is insufficient for lighting purposes. A diffusing element is used for uniformly radiating both the artificial and the dispersed solar light from the fixture into the building interior.

24 Claims, 8 Drawing Figures

15
17
19
14
18
30
28
20
64
32
12
40
22
16
34
26
36
66
38
24
42

122
118
120
128
126
124
130
116
46
50
52
52
52
40
68
79
58
74
58
58
CIRCUITRY
48

80
82
83
84
86
88
90
90'
92
94
66
98
100
102
104
106
108
110
112
114
IV
IV

ARTIFICIAL AND SOLAR LIGHTING SYSTEM

FIELD OF THE INVENTION

This invention relates to a system for illuminating the interiors of buildings by using a combination of sunlight transmitted from the exterior of the building and artificial light generated from within the building.

BACKGROUND OF THE INVENTION

Systems for using sunlight to illuminate the interiors of buildings have been proposed for centuries. Such systems usually involve a receiver located on the roof of the building, a transmission channel within the structure itself, and a distributing element located in the interior of the building from which the light is dispersed. Such systems have usually been neither satisfactory nor commercially successful because of the awkwardness of the designs, the difficulty of construction and maintenance, and the inefficiencies of the receiving, transmitting, and distributing arrangements.

In addition, previous lighting systems utilizing sunlight have focused primarily on transmitting sunlight or a combination of sunlight and air into the interior of a structure. Only a few have provided alternative (artificial) light sources for use should the sunlight become insufficient for lighting purposes, or have provided automatic control; and the few systems which are known appear to be rudimentary in nature and incapable of practical usage to satisfy modern illumination requirements.

Also, few systems have utilized solar light collectors which automatically track the path of the sun, thereby optimizing the transfer of solar light into the structure. Those systems which have used such tracking devices have not provided alternative artificial sources for lighting the structure. Conversely, those system which have provided artificial sources of light have not used the tracking devices which are necessary to provide useful levels of solar illumination within a modern building.

Accordingly, a principal object of this invention is to reduce lighting costs by a simplified and effective system for transmitting sunlight from the exterior to the interior of a building and for automatically generating artificial light when the sunlight becomes unsatisfactory for illumination purposes.

It is an additional object of this invention to optimize transfer of sunlight and to provide for maximum control over its use in lighting the interior of the building.

It is another object of this invention to produce a lighting system, as described above, which utilizes conventional fluorescent lighting fixtures for distributing the solar light into the building interior.

SUMMARY OF THE INVENTION

The present invention, in one illustrative embodiment, involves the collection and concentration of sunlight by a receiving device on the exterior of the building. The receiving device automatically tracks the path of the sun during daylight hours. The concentrated sunlight is directed by the receiving device into a sunlight transmission channel. This channel distributes the sunlight to locations within the building which will utilize the supplemental illumination. Distribution of the sunlight is accomplished by fixtures which contain dispersing elements for scattering the solar light. These fixtures also contain artificial light sources which are automatically switched on when the concentrated sunlight falls to a level that is insufficient to illuminate the building interior. Light from both sources passes through a common diffusing element, resulting in uniform illumination from the fixture.

In accordance with one feature of the invention, sunlight incident on the receiving device passes through a Fresnel lens, that concentrates the light, and is then directed by a reflecting surface into the transmission channel. This reflective surface is automatically repositioned, as the receiving device follows the sun, to keep the concentrated solar light directed into the transmission channel.

Another feature of the invention involves directing the collected sunlight through focusing lenses for further concentrating the sunlight into an intense beam of small cross section. Divergence of the beam, occurring after it passes through the focusing lenses, is corrected by refocusing lenses. The direction of the solar beam is changed by reflective surfaces. The beam is directed into the light fixture by elements which split the beam.

In accordance with another aspect of the invention, a conventional fluorescent light fixture, mounted in the building interior, distributes the solar light. The concentrated solar beam enters the fixture and is applied to one or more dispersing elements which scatter the sunlight across a diffusing element. This diffusing element produces uniform illumination from both the sunlight and the fluorescent light.

A further feature of the invention involves the modification of the broad spectrum of light in the concentrated solar beam by a filter assembly located near the fluorescent fixture. The filters selectively change the color and/or reduce the intensity of light scattered across the diffusing element, thereby enhancing the environmental conditions in the illuminated area.

In accordance with a collateral aspect of the invention, the dispersion of the solar light within the lighting fixture may be accomplished by refracting or reflecting elements placed in the path of the beam.

In these times of concern about the supply and cost of energy, the advantages of such a system are numerous. It is estimated that such a system could nationally save $10 billion per year in the cost of electricity for lighting in commercial buildings. This figure is predicated on reducing the lighting costs in the structures by one-fourth to one-third. Finally, in geographic locations having favorable sunlight conditions, the installation cost of the system would be completely offset by the savings in electricity for artificial lighting in the first year or two after installation.

Other features and advantages of the present invention will become apparent from a consideration of the following detailed description, and from the accompanying drawings.

DETAILED DESCRIPTION

Figures 1, 6:
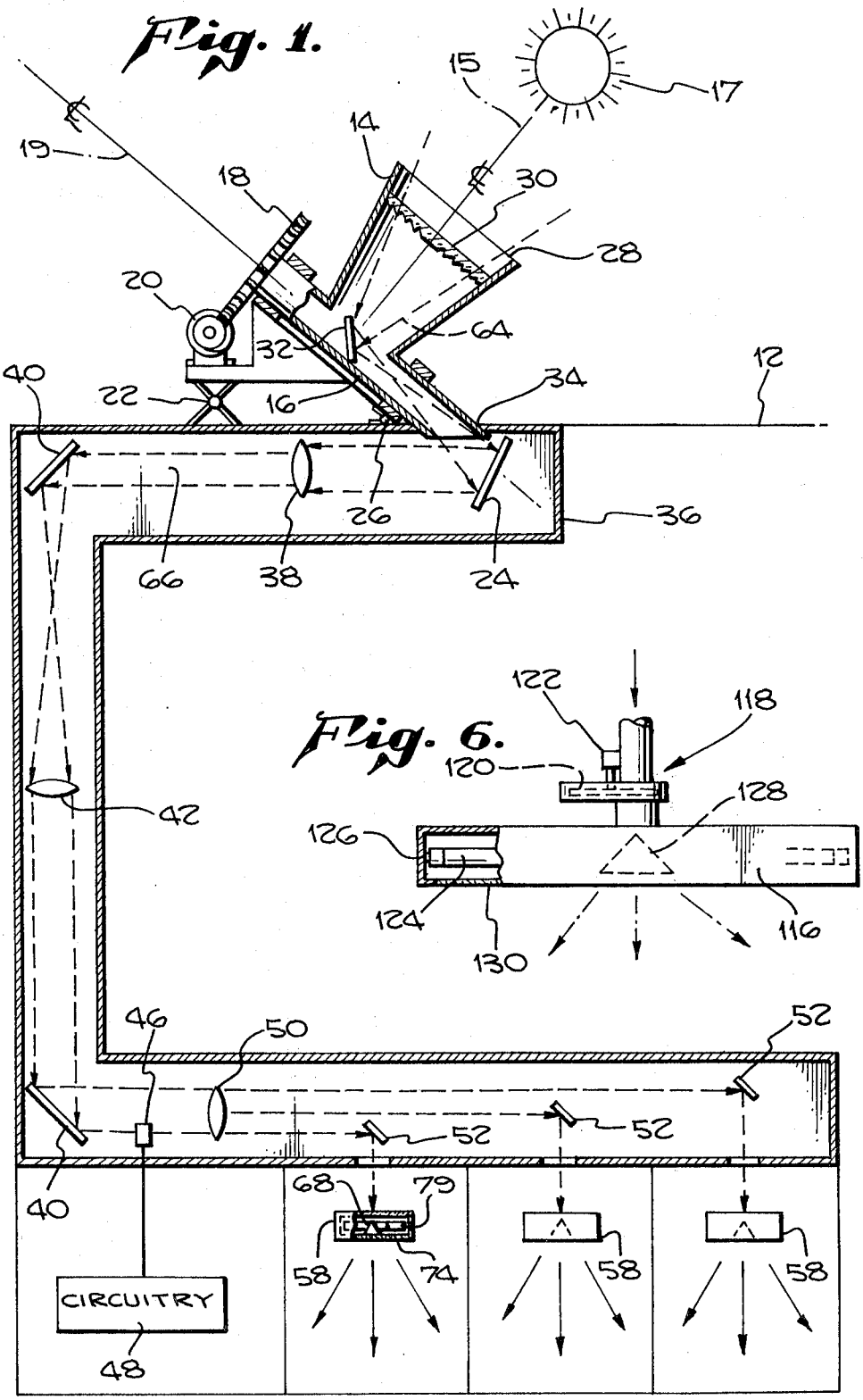
FIG. 1 is a cross-sectional view of the lighting system constructed according to the present invention.
FIG. 6 is a side view of a fluorescent tube fixture containing provisions for connecting to a source of sunlight from the top of the fixture.

Referring more particularly to the drawings, FIG. 1 shows the housing of the sunlight receiving element 14 of the system, mounted to a frame 16. The sunlight receiving element 14 has a central axis 15 which tracks the sun 17, by the rotation of the frame 16 about the axis 19. One end of the frame 16 connects to the roof 12 of the building through a hinge 26. The other end of the frame 16 is connected to a large gear 18 rotated by a motorized drive 20, under the control of clockwork or suitable photoelectric servomechanisms. The motorized drive 20 mounts on a frame 22 which is adjustable in height to shift the elevation of axis 19 about hinge point 26, to provide seasonal adjustments.

The receiving element 14 has a transparent plastic dust cover 28 for protecting a Fresnel lens 30. The Fresnel lens 30 concentrates all incident sunlight 64 into a reflective surface 32 which directs the sunlight along axis 19 through an opening 34 in the roof 12 and into a channel 36, which guides the solar beam to distribution points within the building. The reflective surface 32 rotates with the receiving element 14 to keep the concentrated sunlight 64 directed along axis 19 into the roof opening 34.

The light entering the beam channel 36 is reflected by a reflective surface 24 into a lens 38 which further concentrates the sunlight into a small intense beam 66. As the axis 19 is shifted for seasonal adjustments, the mirror 24 is tilted by an angle equal to one-half of the shift of the axis 19 to continue to direct the incident light onto lens 38. Other reflective surfaces 40 keep the solar beam 66 guided within the channel 36 as the channel changes direction. A refocusing lens 42 corrects divergences in the solar beam 66, as it travels through the channel 36, by recollimating the beam.

The concentrated solar beam 66 is directed from lens 50, to partially impinge on a series of mirrors 52 which each intercept a portion of the beam. Light from this beam splitting arrangement is directed by the orientation of the reflective surfaces 52 into conventional fluorescent tube lighting fixtures 58.

The fluorescent fixtures 58 contain dispersion elements 68, which distribute the solar beam reflected from the reflective surfaces 52 into diffusing plates 74, thereby producing uniform illumination from the fixtures. The fluorescent tubes 79 in the fluorescent fixtures 58 are automatically switched on by a circuit 48 connected to a light sensing device 46 located in the beam channel 36. The fluorescent lights are switched on when the intensity of the solar beam becomes insufficient for lighting purposes.

Figures 2, 3, 4, 5:
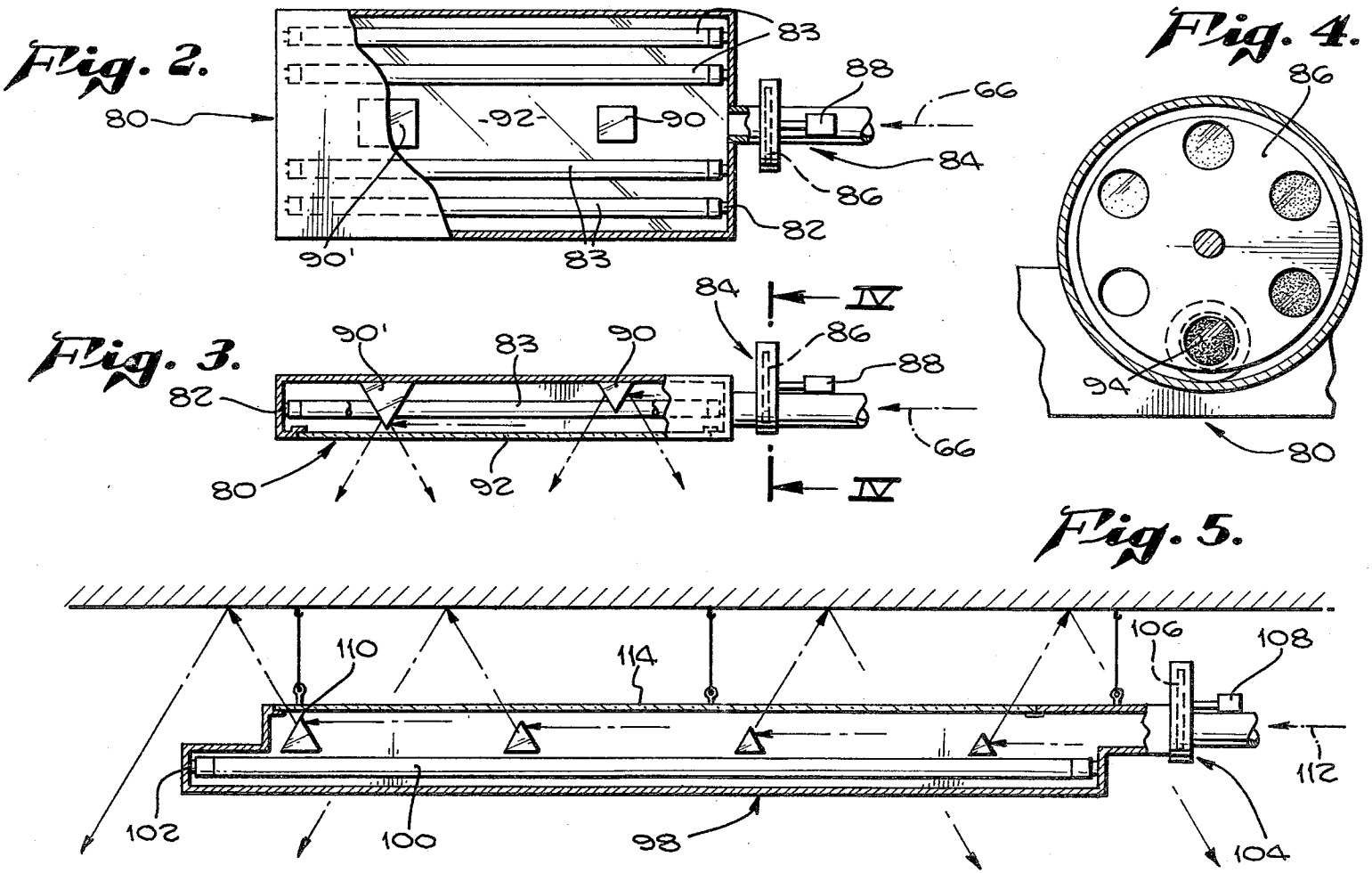
FIG. 2 is a top view of a fluorescent light fixture showing an assembly for connecting to a source of concentrated sunlight and for filtering the sunlight thus received.
FIG. 3 is a side view of the fixture shown in FIG. 2.
FIG. 4 is an end view of the filtering element used with the fluorescent tube fixtures for controlling the intensity of the sunlight.
FIG. 5 is a side view of a fluorescent tube fixture containing a provision for a source of sunlight and designed to project the sunlight and artificial light in an upward direction.

FIGS. 2 and 3 are top and side views, respectively, of a conventional fluorescent lighting fixture 80, which may, for example, be a rectangular box with the top and four sides made of sheet metal, and a lower diffusing plate. Four fluorescent tubes 83 are mounted in sockets 82. The fixture 80 also has a filter and intensity control assembly 84 mounted at one end. The concentrated solar beam 66 in the beam guiding channel 36 is directed into one end of this assembly 84. Upon entering the assembly 84, the solar beam 66 passes through a filtering device 86. This filtering device contains filters of different colors and/or light transmission properties, which may be selectively rotated by a motor 88 into the path of the incoming solar beam 66, thereby changing the intensity and/or color of the transmitted light.

After passing through the filtering device 86, the solar beam 66 strikes a plurality of optical elements 90 which spread the concentrated solar beam 66 across the bottom of the fixture 80. Artificial light from the fluorescent tubes 83 and dispersed solar light from the optical elements 90 pass through a diffusing plate 92 which provides uniform illumination from the fixture. The elements 90 may be transparent or reflective, or may have partially reflective coatings on the input surfaces so that light is partially reflected and partially refracted both from the smaller element 90 and the larger element 90' over the entire surface of the diffusing plate 92.

FIG. 4 shows a side view of the filtering device 86 located in the assembly 84 which attaches to the fluorescent fixture 80. The filtering device 86 may include a plurality of pieces of translucent material 94 of different colors and transmission properties mounted in a circular frame 92. As may be appreciated by those who are familiar with the principles of environmental illumination, various colors or tints produce different effects, and this refinement, in combination with the broad spectrum of light included in solar radiation, gives flexibility in utilizing the desired effects.

FIG. 5 is a side view of a fluorescent fixture 98 similar to the fixture 80 shown in FIG. 3. This fixture also contains fluorescent tubes 100 mounted in sockets 102 and an assembly 104 containing a filtering device 106 and its accompanying motor drive 108. This fixture 98, however, is designed to be suspended from a building ceiling rather than mounted within the ceiling. Consequently, the optical elements 110 which disperse the incident solar beam 112 are oriented in such a manner that the solar light is dispersed through the top portion of the fixture 98. Likewise, the diffusing plate 114 in the fixture is positioned at the top of the fixture, rather than at the bottom of the fixture as in FIG. 3. Alternatively, the fixture may be open at the top to permit the application of higher intensity illumination to the ceiling.

FIG. 6 is a side view of a similar fixture 116 in which the assembly 118 containing the filtering device 120 and its accompanying motor drive 122 is mounted to the top of the fixture, rather than to the side of the fixture, as shown in FIGS. 3 and 5. Fluorescent tubes 124 and sockets 126, similar to those shown in FIGS. 3 and 5, are provided in this fixture. The fixture 116 contain optical dispersing elements 128 and a diffusing plate 130 similar to those shown in FIGS. 3 and 5.

Figure 7:
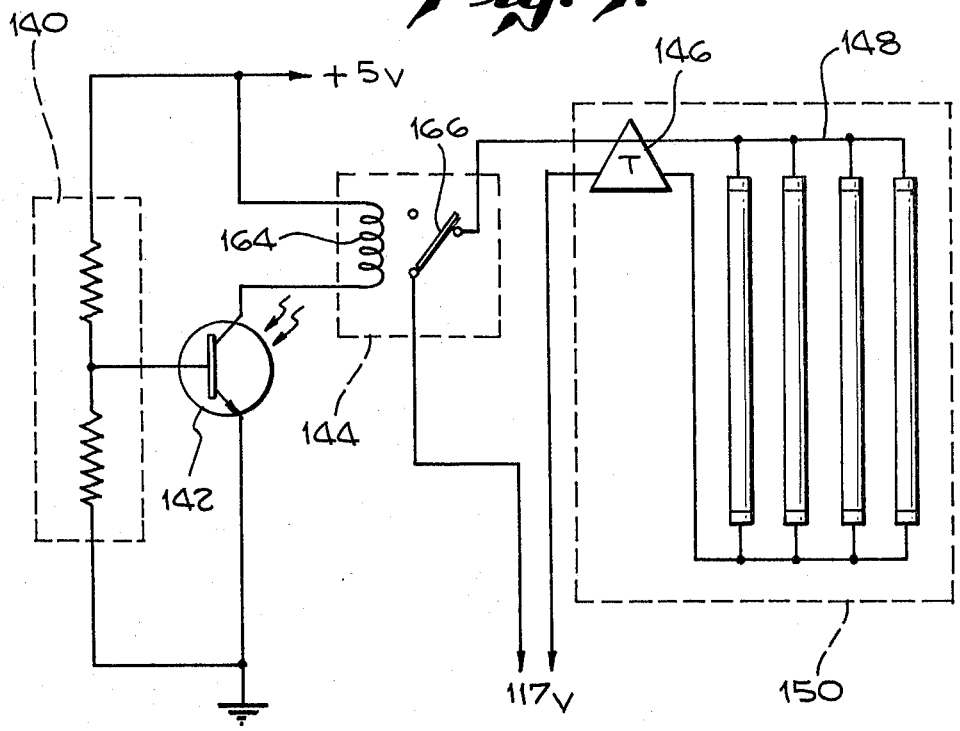
FIG. 7 is a typical schematic diagram of the circuitry to control the artifical light sources in the fluorescent light fixture.

FIG. 7 shows typical circuitry to automatically switch on the fluorescent tubes in the fixtures discussed above. In the circuit, a phototransistor 142 is mounted in the beam guiding channel such that the light from the solar beam falls upon the phototransistor. When the intensity of the solar beam is insufficient for lighting purposes, phototransistor 142, by means of its biasing network 140, is in the cutoff state. As a result, insufficient current is supplied to the coil 164 of a relay 144, connected to the collector of the photo-transistor 142, to open the relay contacts 166 of the relay 144. As a result, 117 v is supplied to the ballast transformer 146 in the fluorescent lighting fixture 150. The ballast transformer then supplies voltage to the fluorescent tubes 148 in the fixture 150, thereby lighting the tubes.

When the intensity of the solar beam rises to a sufficient level for illumination purposes, the photo-transistor 142 goes into the saturation state. This causes a sufficient amount of current to flow through the relay coil 164 to open the relay contacts 166. This removes the voltage from the ballast transfer 146 and thereby turns off the fluorescent tubes.

Figure 8:
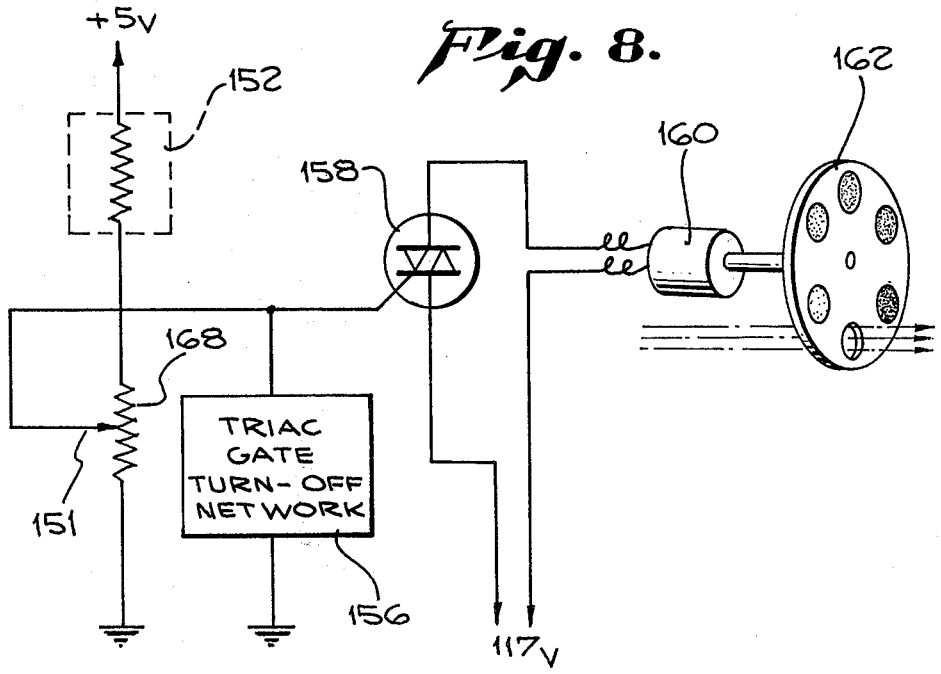
FIG. 8 is a typical schematic diagram of the circuitry to rotate the filtering element attached to the fluorescent lighting fixtures.

FIG. 8 shows typical circuitry to rotate the filtering device through which the solar beam entering the fluorescent fixtures must pass. In this circuit, a potentiometer 168 and its voltage divider network 152 supply a variable current to the gate of a TRIAC 158. The gate current to the TRIAC 158 modifies its internal dynamic resistance. The TRIAC 158 is connected in the 117 volt power circuit which supplies AC voltage to an AC motor 160 which turns the filter wheel 162 through which the solar beam passes. The potentiometer 168 is located at a convenient point within the area to be illuminated, and is controlled by a shaft 151 extending from its casing. When the potentiometer 168 control shaft 151 is moved, the resistance of the potentiometer is changed, thereby altering the gate current supplied to the TRIAC 158. This changes the resistance of the TRIAC 158, and thus the voltage supplied to the AC motor 160. When the potentiometer 168 is at maximum resistance, the TRIAC 158 is at a minimum resistance and the AC motor 160 will turn, thereby rotating different filtering elements through the path of the solar beam. When the potentiometer 168 is at minimum resistance, the TRIAC 158 is at maximum resistance and the motor will have insufficient voltage applied to it to enable it to rotate the filter wheel 162. An additional network 156 is used to assist the potentiometer 168 in removing gate current from the TRIAC 158. A relatively slow rotation of the disc 162 is normally to be preferred so that it may be readily stopped at the desired orientation.

Returning to a consideration of the prior proposals of others, reference will be made to several prior patents. D. M. MacDuff, in U.S. Pat. No. 1,254,520, granted Jan. 22, 1918 and entitled "Combined Light and Air Transmitting Apparatus", discloses a system for lighting the interior of a building by a combination of skylight and an incandescent bulb. This system utilizes a fixed skylight collector on a building roof, a single focusing lens to concentrate the skylight, mirrors to direct the path of the concentrated light, another lens to diffuse the skylight, and an incandescent bulb to provide alternative lighting. The incandescent bulb can be rotated into the light channel by pulling a chain extending through the building's ceiling into its interior. It appears improbable, from a consideration of this patent that useful levels of illumination would be provided (in the absence of arrangements to track the sun) by the system either by the incandescent bulb or by the skylight.

J. T. Foster, in U.S. Pat. No. 3,511,559, granted May 12, 1970 and entitled "Light Transmitting and Distributing Device", discloses a system intended to illuminate the interiors of buildings with skylight. The system utilizes a fixed skylight collector, reflecting mirrors, and a light-dispersing fixture designed to reflect the collected sunlight from the building's ceiling to its interior. The system lacks any apparatus to track the sun or to focus the collected light into a beam and as a result, requires a light channel of large cross section to transmit any effective amount of illumination to the building's interior. In addition, a special fixture and highly reflective ceiling surface are disclosed for the distribution of what skylight reaches the fixture. Also, no type of alternative lighting exists in the system for use should the skylight become insufficient for illumination purposes.

J. W. Davis, in U.S. Pat. No. 507,999, granted Nov. 7, 1893 and entitled "Apparatus for Lighting Buildings", discloses a system for transmitting sunlight to the interiors of buildings, with no artificial lighting being provided. The system utilizes a sunlight collector which tracks the path of the sun and a straight, reflective channel for transmitting the collected sunlight to mirrors which direct it into the building interior. Besides lacking any provision for routing the sunlight in any direction but a straight one, the system also lacks any element which would correct the divergence in the beam of sunlight created by the parabolic reflector used in the collecting element. In addition, the sunlight which is transmitted to the building interior from the system is the same intense beam created by the parabolic reflector; no provision exists for diffusing the beam over a surface to provide a more dispersed form of illumination.

A. R. Jentoft, in U.S. Pat. No. 3,488,505, filed Apr. 5, 1967 and entitled "Skylight and Artificial Light Illumination System With Automatic Control of Lighting Intensity", discloses skylights in a building, through which sunlight passes, and artificial lighting controlled by a photocell mounted in the skylight. The system is only effective for lighting building interiors which are exposed to such skylights.

In the foregoing description of the present invention, several illustrative embodiments of the invention have been disclosed. It is to be understood that other mechanical and design variations are within the scope of the present invention. Thus, by way of example and not of limitation, the elements for controlling the color and intensity of the solar beam could be in series instead of forming an integral unit; different types of diffusing elements could be used in the lighting fixtures, including the well-known egg-crate style; the solar beam dispersing elements could be of the reflective or of the refractive type; the sunlight collecting element could utilize reflecting or refracting elements other than a Fresnel lens; and the electric control circuitry could have other components which accomplish the desired function. Accordingly, the invention is not limited to the particular arrangements which are illustrated and described in detail.

What is claimed is:

1. A system for lighting the interior of a building through the use of sunlight and conventional type lighting fixtures comprising:

receiving means for collecting and concentrating sunlight;

tracking means for orienting said receiving means to follow the movement of the sun;

beam guiding means for directing concentrated sunlight from said receiving means to a plurality of locations in said buildings where distribution of said sunlight is to occur;

sensing means for detecting a predetermined intensity of sunlight transmitted through said beam guiding means;

lighting fixtures, including a rigid frame and containing means for mounting fluorescent lighting tubes therein, said lighting fixtures being mounted throughout said building immediately above the areas in said building which are to be illuminated;

switching means for turning off electric power supplied to said fixture means when said sensing means indicates sufficient sunlight to illuminate the interior of said building;

means for directing said concentrated sunlight from said beam guiding means into said lighting fixture;

filtering means located near the juncture of said beam guiding means and said frame means for selectively controlling the intensity of the concentrated sunlight radiation admitted to said lighting fixture;

dispersing elements mounted within said frame for scattering said sunlight exiting from said filtering means; and diffusing means for receiving both artificial light and dispersed sunlight, and for providing uniform illumination into said building interior from both said artificial light and said dispersed sunlight.

2. The system as defined in claim 1, wherein said sunlight receiving means comprises:

covering means for protecting said receiving means from dust and other foreign objects when said system is not in use;

a Fresnel lens to direct said sunlight entering said receiving means into a concentrated beam of small cross-section;

reflecting means for directing said concentrated solar beam from said Fresnel lens into said beam guiding means; and positioning means for automatically adjusting said reflecting means to maintain said cocentrated solar beam directed into said beam guiding means as said receiving means is moved by said tracking means.

3. The system as described in claim 1, wherein said beam guiding means comprises:

channel means for enclosing said solar beam from said receiving means;

reflecting means for directing said solar beam from said receiving means into said channel means;

focusing means for further concentrating said solar beam entering said channel means into an intense beam of small cross-section;

a plurality of additional reflecting means for maintaining said concentrated solar beam centralized within said channel means as said channel means changes direction;

a plurality of refocusing means for correcting divergences in said concentrated solar beam as said solar beam travels down said channel means; and beam splitting means for routing said concentrated solar beam to a plurality of locations within said building.

4. A system for supplying sunlight or solar light and artificial light to the interior of a building, comprising:

a substantially conventional type of rectangular fluorescent lighting fixture for solar light and artifical light;

socket means for fixedly mounting a plurality of fluorescent lighting tubes in said fixture;

electric circuit means for supplying electric power to said lighting tubes;

means for supplying a concentrated beam of solar light to said fixture;

broad area diffusing means for providing uniform illumination from said fixture from both said lighting tubes and said solar beam; and deflection means for directing said solar beam across the surface of said diffusing means.

5. A system as defined in claim 4, further comprising filtering means for selectively controlling the intensity of the solar beam radiation entering said lighting fixture.

6. The system as defined in claim 5, wherein said filtering means comprises:

a plurality of elements of translucent material of varying colors fixedly mounted in a frame; and means for directing the concentrated beam of solar light through a selected one of the elements.

7. The system as defined in claim 4, wherein said means for supplying solar light is mounted to the side of said fixture farthest from the floor of said building.

8. The system as defined in claim 4, wherein said means for supplying solar light is mounted to the side of said fixture in a direction parallel to said fluorescent lighting tubes.

9. A system as defined in claim 4, further comprising means for mounting a plurality of said fixtures overhead within said building interior.

10. The system as defined in claim 4, wherein means are mounted for directing said solar light and said artificial light downwardly from said fixture.

11. The system as defined in claim 4, wherein means are mounted for directing said solar light and said artificial light upwardly from said fixture.

12. A system for lighting the interior of a building through the use of sunlight and artificial light, comprising:

receiving means for collecting and concentrating sunlight;

tracking means for orienting said receiving means to follow the movement of the sun;

beam guiding means for directing concentrated sunlight from said receiving means to a plurality of locations in said buildings where distribution of said sunlight is to occur;

sensing means for detecting a predetermined intensity of sunlight transmitted through said beam guiding means;

illumination source means for generating artificial light;

switching means for turning off electric power supplied to said illumination means when said sensing means indicates sufficient sunlight to illuminate the interior of said building;

rigid fixture means including a socket for supporting said illumination source means and for receiving said concentrated sunlight from said beam guiding means, said fixture means being of a generally conventional type mounted within said building above the area to be illuminated;

dispersing means associated with said fixture for scattering said received sunlight; and translucent diffusing means associated with each fixture for providing reasonably uniform illumination into said building interior from both said artificial light and said dispersed sunlight, with specific areas on said diffusing means receiving and diffusing both of said types of illumination.

13. A system for supplying sunlight or solar light and artificial light to the interior of a building, comprising:

a substantially conventional type of fluorescent lighting fixture for sunlight and artificial light;

socket means for fixedly mounting a plurality of fluorescent lighting tubes in said fixture;

electric circuit means for supplying electric power to said lighting tubes;

means for supplying a concentrated beam of sunlight to said fixture; and deflection means mounted within said fluorescent lighting fixture for dispersing or diffusing said sunlight to thereby provide either artificial or solar illumination from said fluorescent light fixture.

14. A system as defined in claim 13 further comprising means for selectively varying the intensity of the sunlight radiation supplied to said lighting fixture.

15. A system as defined in claim 13 wherein a plurality of said fixtures are provided, and further comprising means for splitting said sunlight beam and applying a portion thereof to each said fixture.

16. In a lighting system utilizing fluorescent light and sunlight, an improved lighting fixture including a generally conventional type of fluorescent light fixture, fluorescent tubes mounted therein, and a diffusing plate across the lower surface thereof, the improvement comprising:

a plurality of optical means for refracting or reflecting said sunlight beam across said diffusing plate; said means being placed in the path of said beam; and beam guiding means for directing said sunlight beam into said optical means.

17. A system for lighting the interior of a building through the use of sunlight and artificial light, comprising:

receiving means for collecting and concentrating sunlight;

tracking means for orienting said receiving means to follow the movement of the sun;

beam guiding means for directing concentrated sunlight from said receiving means to a plurality of locations in said buildings where distribution of said sunlight is to occur;

illumination source means for generating artificial light;

switching means for turning off electric power supplied to said illumination means when there is sufficient sunlight to illuminate the interior of said building;

rigid frame means, including electrical sockets for supporting said illumination source means, and for receiving said concentrated sunlight from said beam guiding means, said frame means being mounted directly over the areas in said building to be illuminated;

dispersing means associated with said frame for scattering said received sunlight;

means included in the path from said sunlight receiving means to said dispersing means for establishing the intensity of the sunlight supplied to said dispersing means; and diffusing means having surface areas receiving artificial light and sunlight and providing reasonably uniform illumination from both said artificial light and said dispersed sunlight.

18. A system for supplying sunlight or solar light and artificial light to the interior of a building, comprising:

receiving means for collecting and concentrating sunlight;

tracking means for orienting said receiving means to follow the movement of the sun;

a rigid lighting fixture of a generally coventional fluorescent fixture type for solar light and artificial light;

socket means for fixedly mounting a plurality of fluorescent lighting tubes in said fixture;

electric circuit means for supplying electric power to said lighting tubes;

means for supplying a concentrated beam of sunlight from said receiving means to said fixture;

broad area diffusing means having surface areas receiving both artificial light and sunlight and providing uniform illumination from said mixture from both said lighting tubes and said solar beam;

deflection means for directing said solar beam across the surface of said diffusing means;

means for sensing the intensity of the collected sunlight; and switching means for turning off the power to said fluorescent lighting tubes when the sunlight is sufficiently intense to provide adequate illumination.

19. A system as defined in claim 18, further comprising filtering means for controlling the intensity of the solar beam radiation entering said lighting fixture.

20. A system as defined in claim 18, further comprising means for mounting a plurality of said fixtures overhead within said building interior.

21. The system as defined in claim 18, wherein mounting means are provided for directing said solar light and said artificial light downwardly from said fixture.

22. A system as defined in claim 18, wherein a plurality of said fixtures are provided, and including conduit means for directing said concentrated sunlight from said receiving means to a plurality of said fixtures.

23. A system as defined in claim 18 further comprising means for selectively varying the intensity of the sunlight radiation supplied to said lighting fixture.

24. A system as defined in claim 18 wherein a plurality of said fixtures are provided, and further comprising means for splitting said sunlight beam and applying a portion thereof to each said fixture.

* * * * *